US010106286B2

(12) United States Patent
Snedecor et al.

(10) Patent No.: US 10,106,286 B2
(45) Date of Patent: Oct. 23, 2018

(54) LABEL APPLYING APPARATUS

(71) Applicants: Mark Snedecor, Fort Worth, TX (US); Robert C. Zuilhof, Azle, TX (US)

(72) Inventors: Mark Snedecor, Fort Worth, TX (US); Robert C. Zuilhof, Azle, TX (US)

(73) Assignee: ID TECHNOLOGY LLC, Fort Worth, TX (US)

( * ) Notice: Subject to any disclaimer, the term of this patent is extended or adjusted under 35 U.S.C. 154(b) by 786 days.

(21) Appl. No.: 14/603,683

(22) Filed: Jan. 23, 2015

(65) Prior Publication Data

US 2016/0214360 A1 Jul. 28, 2016

(51) Int. Cl.

| | |
|---|---|
| ***B65C 9/00*** | (2006.01) |
| ***B65C 1/00*** | (2006.01) |
| ***B65C 1/02*** | (2006.01) |
| ***B65C 9/18*** | (2006.01) |
| ***B65C 9/30*** | (2006.01) |

(52) U.S. Cl.

CPC ..... *B65C 9/0006* (2013.01); *B65C 1/025* (2013.01); *B65C 9/1876* (2013.01); *B65C 9/30* (2013.01)

(58) Field of Classification Search

CPC ..... B65C 9/00; B65C 9/0006; B65C 9/10; B65C 9/18; B65C 9/18; B65C 9/187; B65C 9/187; B65C 9/1876; B65C 9/30; B65C 1/00; B65C 1/02; B65C 1/02; B65C 1/025

See application file for complete search history.

(56) References Cited

U.S. PATENT DOCUMENTS

| | | | | |
|---|---|---|---|---|
| 3,779,829 | A * | 12/1973 | Wolff | B65C 3/14 156/361 |
| 4,680,082 | A * | 7/1987 | Kearney | B65C 9/1876 156/497 |
| 5,399,228 | A | 3/1995 | Schroeder et al. | |
| 5,660,676 | A * | 8/1997 | Brooks | B65C 9/1869 156/361 |
| 6,368,446 | B1 | 4/2002 | McNestry | |
| 6,596,105 | B2 | 7/2003 | Kendal, Jr. | |
| 6,640,865 | B1 | 11/2003 | Morikawa | |
| 2007/0074809 | A1* | 4/2007 | Phillips | B31D 1/021 156/256 |
| 2009/0126850 | A1* | 5/2009 | Fletcher | B65C 3/16 156/60 |

FOREIGN PATENT DOCUMENTS

| | | |
|---|---|---|
| EP | 1057731 | 5/2000 |

* cited by examiner

*Primary Examiner* — Seyed Masoud Malekzadeh
*Assistant Examiner* — Matthew Hoover
(74) *Attorney, Agent, or Firm* — Thompson Hine LLP

(57) ABSTRACT

Labeling apparatuses for labeling moving items are disclosed having a label release mechanism for releasing labels from a backing, a plate having a support surface with at least one opening through the plate, a fan positioned to create a negative pressure effect at the support surface of the plate, and a free-spinning roller positioned at a downstream end of the support surface for receiving labels that pass along the support surface. The roller has an outer surface portion that includes a nip zone for contacting a moving item application surface to which the label will be applied. A method of applying a label using the disclosed labeling apparatuses is also disclosed and includes utilizing a label support surface and a free-spinning roller, receiving a label, generating a negative pressure effect, supporting the label as it travels to the nip zone, and adhering the label to the moving item.

19 Claims, 13 Drawing Sheets

LABEL APPLYING APPARATUS

TECHNICAL FIELD

The present application relates generally to labeling devices and more particularly to devices for labeling items as the items are conveyed along a path.

BACKGROUND

Material handling systems are used many different industries and often include complex packaging and conveyor systems that convey items quickly from one place to the next within a facility or multiple facilities. Labeling is often necessary to convey information about the items so that the items can be identified, categorized, and/or properly routed, among other reasons. Placing labels on items that are moving along a conveyance path within a material handling system presents unique challenges, which industry has sought to overcome by using complex electro-mechanical or electro-pneumatic systems that rely on many moving parts and a high degree of complexity. Examples of these existing systems include label applicators that use pneumatic cylinders to press labels on as the items go by and label applicators that employ complex arrangements of electrical motors and mechanical components to apply the labels to the items. Many such systems have numerous adjustment points. Moreover, in labeling devices that incorporate a printer, the label print speed must generally be matched to the speed of item conveyance for proper system operation.

It would be desirable to provide a label applying apparatus of reduced complexity in terms of operation or adjustment and/or a label applying apparatus that enables label print speed to vary from the conveyance speed of items being labeled.

SUMMARY

The present application is directed to a labeling apparatus having a label release mechanism for releasing labels from a label stock backing along a release path; a plate having a support surface with at least one opening through the plate, the support surface having an upstream end positioned to receive labels exiting the release mechanism along the release path; a fan positioned to create a negative pressure effect at the at least one opening in the support surface of the plate for holding labels against the support surface as the labels travel along the support surface; and a free-spinning roller positioned at a downstream end of the support surface for receiving labels that pass along the support surface. The roller has an outer surface portion that includes a nip zone positioned for contacting a moving item application surface to which the label will be applied.

In one aspect of the labeling apparatus, the label release mechanism releases labels with a non-adhesive label side facing the support surface and an adhesive label side facing away from the support surface. In another aspect of the previous embodiments, the roller is a compliant roller and the outer surface portion is resilient. In one embodiment, the item application surface contacts and displaces the outer surface portion of the compliant roller in the nip zone. In another embodiment, displacement of the outer surface portion of the compliant roller compensates for contour irregularities in the item application surface.

In another aspect of the previously described embodiments, the contact between the outer surface portion of the roller and the item application surface causes label speed to be matched to a speed of the item application surface. In another aspect of the previous embodiments, the fan is positioned to create a flow of air through the at least one opening in the plate, from the support surface to a rear surface, thereby creating the negative pressure effect along the support surface of the plate. In some embodiments, the labeling apparatus further includes a plenum extending from a rear surface of the plate. In some of these embodiments, the fan is positioned in the plenum.

In another aspect of the previously described embodiments, the plate is dimensioned so that a leading edge of the label reaches the nip zone just after a trailing edge of the label fully releases from the label stock backing at the label release mechanism. In another aspect, the plate is dimensioned so that a leading edge of the label reaches the nip zone before the forward momentum of the label ceases.

In another aspect of the previous embodiments, the labeling apparatus includes a label printer located along a label stock path upstream of the label release mechanism and a label stock drive arrangement for moving label stock along the label stock path past the printer and about the label release mechanism. The linear speed of the label stock drive arrangement does not match a linear speed of the moving item application surface.

In another aspect of the present application, a label merge module includes: a label support surface with an upstream end and a downstream end and at least one opening therethrough, the opening located between the upstream end and the downstream end; a means for creating a negative pressure effect at the at least one opening in the label support surface for holding labels against the label support surface as the labels travel along the label support surface from the upstream end to the downstream end; and a free-spinning roller positioned at the downstream end of the label support surface for receiving labels from the label support surface to apply the labels to moving items.

In another aspect of the previous embodiment, the means for creating the negative pressure effect is a fan positioned to draw air through the at least one opening of the support surface. In another aspect of the previous two embodiments, the label support surface is an external surface of a plate and the means for creating the negative pressure effect further includes a plenum extending from an opposite surface of the plate. In another aspect of the previous embodiments, the fan is positioned to draw air through the plenum.

In another aspect of the previous embodiments, the label merge module includes a service feature moveably engaging the label merge module with a labeling apparatus. In another aspect of the previous embodiments, the service feature includes a baseplate, which is coupled to the labeling apparatus and defines a recess and a through opening, and a cam assembly. The cam assembly has a cam slideably engageable with the recess of the baseplate and a shaft engageable with the cam and extending through the through opening of the baseplate to engage with the label merge module. Tightening engagement of the shaft engages the cam with the baseplate to define a position of the label merge module relative to the labeling apparatus, and loosening engagement of the shaft with the cam relaxes engagement of the cam with the baseplate and allows the cam to slide along the recess defined by the baseplate to change the position of the label merge module relative to the labeling apparatus.

According to another aspect of the present application, a label merge module includes a support surface defining a label guide path and a roller positioned to be in contact with a moving item application surface to create a nip between the roller and the item application surface. The roller is free-spinning, and the support surface is positioned to receive a label as it releases from a label stock and to support the label until it reaches the roller. The plate is dimensioned so that a leading edge of the label reaches a nip zone of the roller after a trailing edge of the label fully releases from the label stock backing. In another aspect of the previous embodiment, the label merge module includes at least one opening in the support surface and a fan positioned to create a negative pressure effect at the at least one opening in the support surface.

In another aspect of the present application, a method of applying a label to a moving item includes utilizing a label support surface having an upstream end, a downstream end, and at least one opening and utilizing a free-spinning roller having an outer surface portion. The roller is proximate to the downstream end of the label support surface and positioned to have the outer surface portion in contact with an application surface of the moving item to be labeled to create a nip zone therewith. The method also includes receiving a leading edge of the label at the upstream end of the label support surface as the label is released from a label stock supply; generating a negative pressure effect at the label support surface to draw an air flow through the at least one opening; supporting the label as it moves across the label support surface, the negative pressure effect at the label support surface holding the label against the label support surface as the label moves into the nip zone; and adhering the label to the application surface of the moving item by moving the label through the nip zone as the roller rotates and presses an adhesive side of the label against the application surface.

In another aspect of the previous embodiment, the method includes matching a speed of the label with a speed of the application surface of the moving item. The roller accelerates or decelerates the label, as it moves into the nip zone, to match the speed of the label with the speed of the application surface. In another aspect of the previous two embodiments, the method further includes compensating for one or more contour irregularities in the application surface of the moving item. The roller is a compliant roller having an outer surface portion that is resilient. The outer surface portion is partially displaced through contact with the application surface of the moving item, and a degree of partial displacement of the outer surface portion of the roller changes in response to the one or more contour irregularities in the application surface.

DESCRIPTION

Figure 1A:
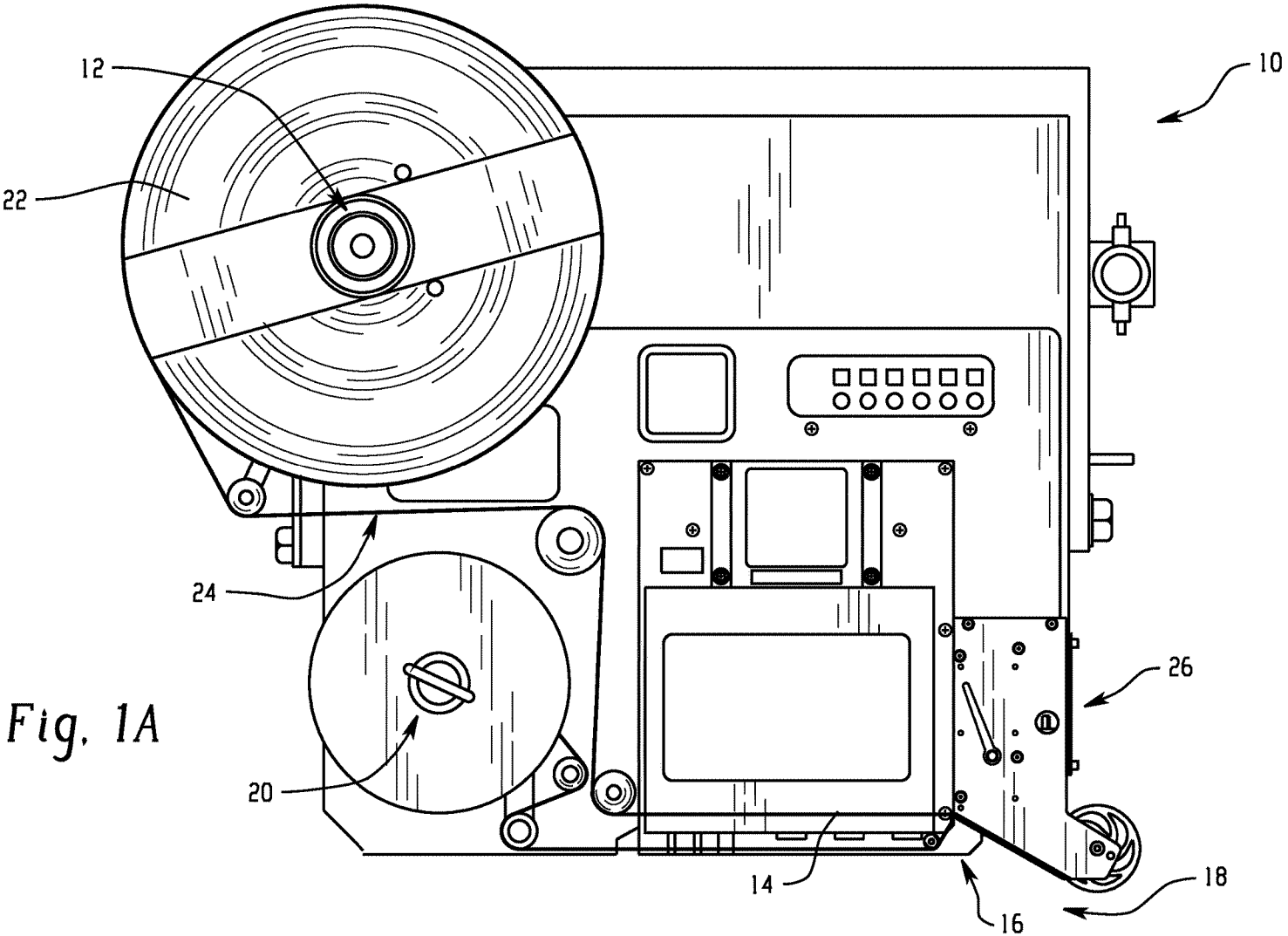
FIG. 1A is a front elevation view of an embodiment of a labeling apparatus having a label applying assembly.
Figure 1B:
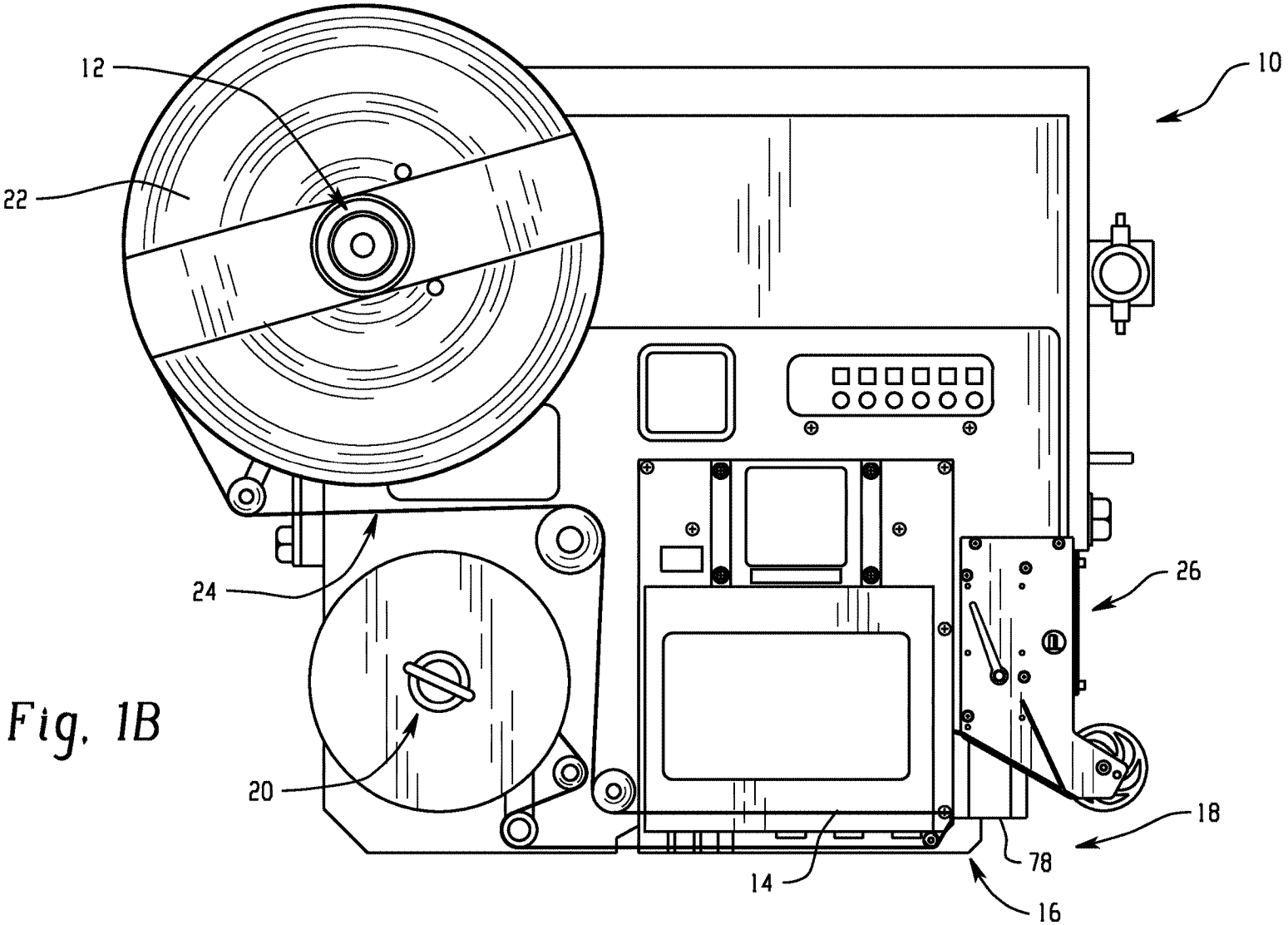
FIG. 1B is a front elevation view of the labeling apparatus of FIG. 1 showing the label applying assembly adjusted to an alternate position.
Figure 3:
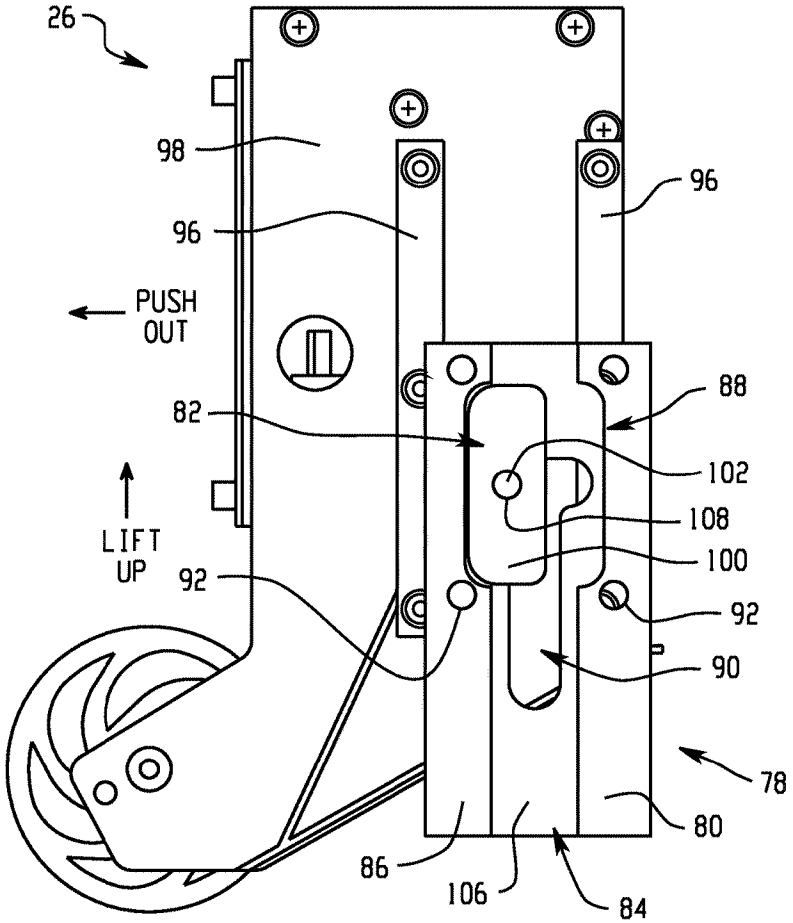
FIG. 3 is a rear elevation view of the label applying assembly of FIG. 2 adjusted to an alternate position.
Figure 2:
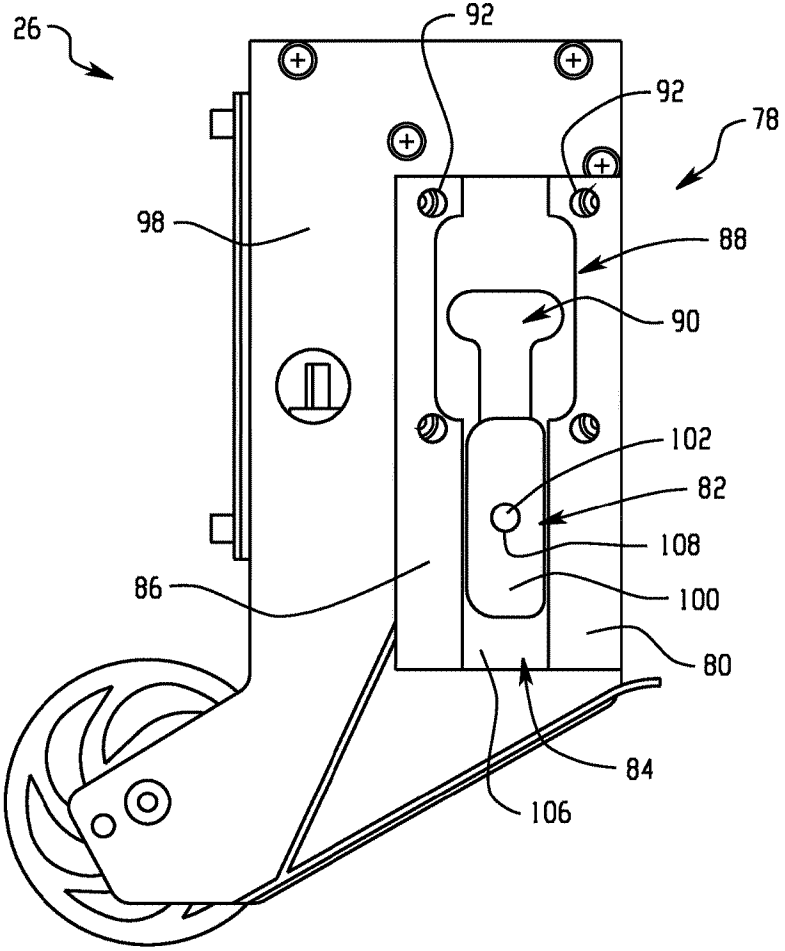
FIG. 2 is a rear elevation view of a label applying assembly for use with the labeling apparatus of FIGS. 1A and 1B.
Figure 4:
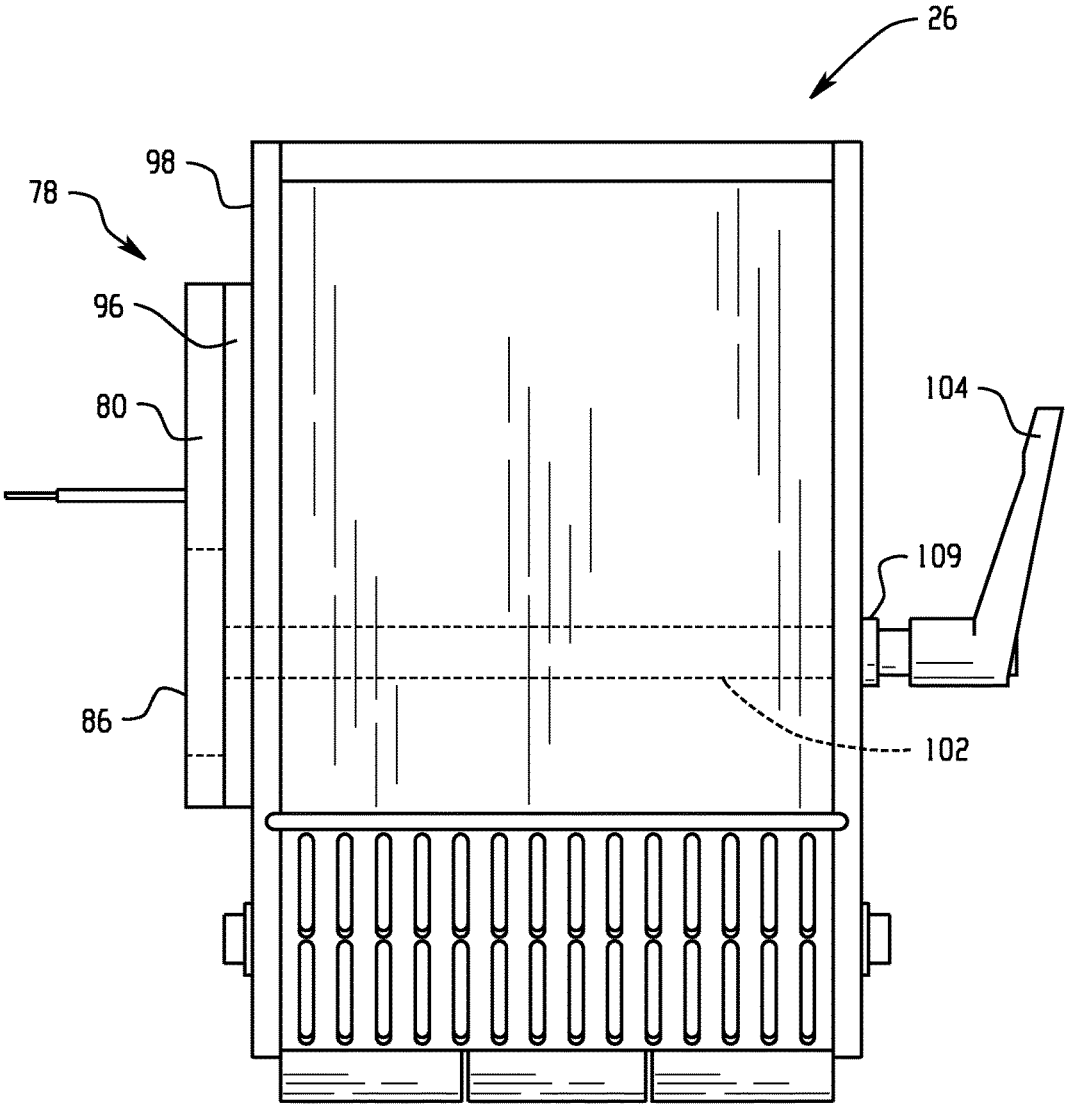
FIG. 4 is a side elevation view of the label applying assembly of FIG. 2.
Figure 5:
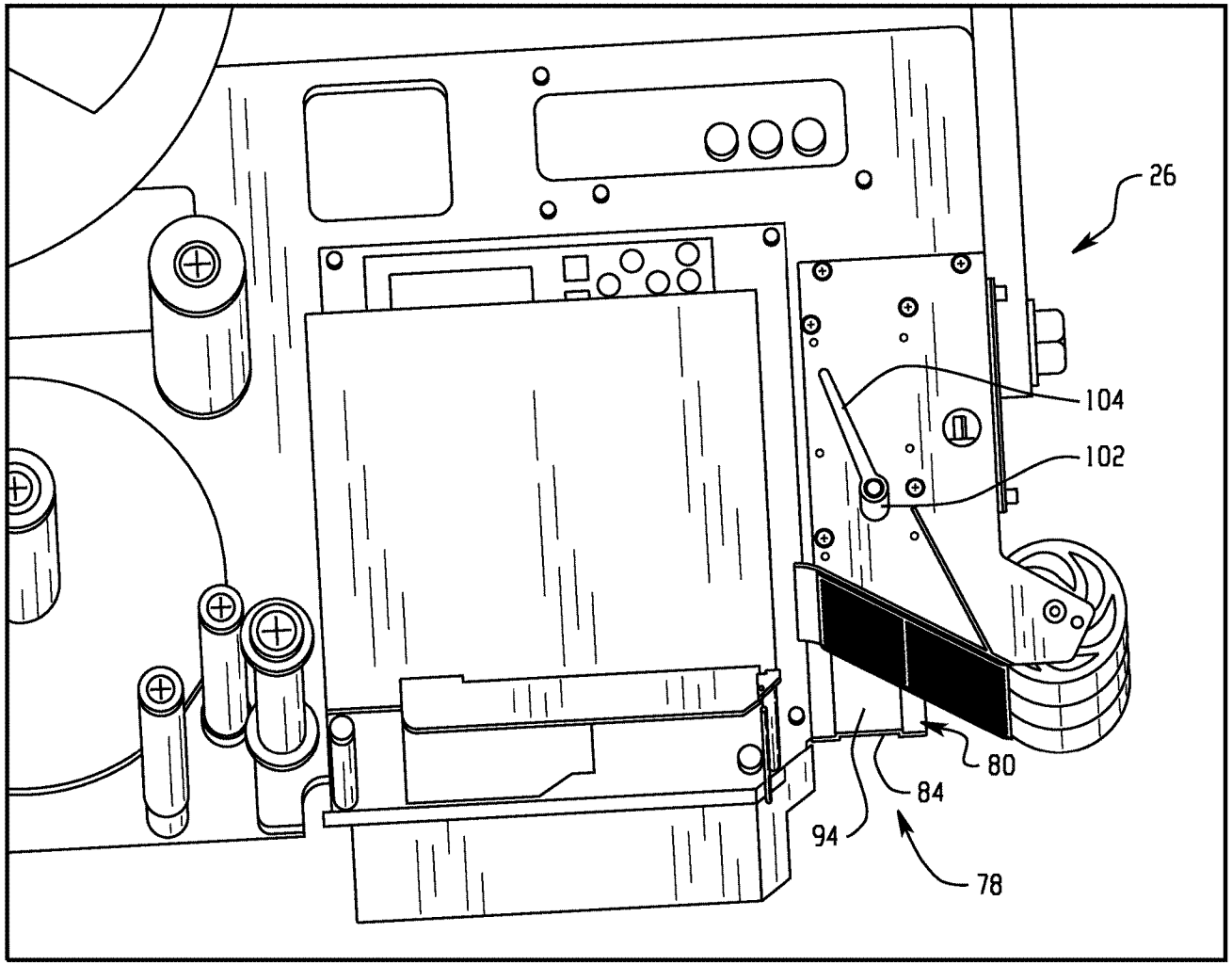
FIG. 5 is a front perspective view of the labeling apparatus of FIGS. 1A and 1B showing the label applying assembly adjusted to an alternate service position.

Referring to FIGS. 1A and 1B, a labeling apparatus 10 is disclosed for labeling moving items, which may, by way of example, include, but are not limited to, boxes, cartons, cases, containers, skids/pallets, packaging, plastic packaging, shrink-wrapped containers, or other items. The labeling apparatus 10 includes a label stock supply reel 12, a label printer 14, a label release mechanism 16, a label applying zone 18, and a label backing take-up reel 20. In some embodiments, the labeling apparatus 10 may be used to apply pre-printed labels, in which case the label printer 14 would be optional. In the labeling apparatus 10 of FIG. 1A, the label stock 22, which includes both a liner or backing and multiple labels applied to a release surface of the liner or backing, generally travels along the label stock path 24 from the label stock supply reel 12, past the label printer 14 for printing and then by a release mechanism 16 (e.g., a peel bar or edge about which the label backing sharply turns to effect label release). A label stock drive arrangement (not shown) may include one or more motors that operate to rotate one or more rollers associated with one or more roller nips through which the label stock passes and/or operate to rotate the take-up reel 20. Once released, the label is then applied to a moving item by the label applying assembly 26 at the label applying zone 18. The label stock backing is then accumulated on the backing take-up reel 20.

The label applying assembly 26 may be of module configuration, enabling it to be installed and removed from the apparatus 10 without impacting the function or operation of the other parts of the apparatus. In this regard, FIG. 1A shows the assembly 26 in an operation position, while FIG. 1B shows the assembly 26 in an upwardly and laterally (to the right in FIG. 1B) shifted position (service position) that will enable access to the printer components. The mounting of the module or assembly 26 is achieved by a service feature 78 (which may also be referred to herein as a mounting feature or interface feature) that allows the label applying assembly 26 to be moved between the operation position and the service position.

Referring now to FIGS. 2-5, the service feature 78 includes a baseplate 80 and a cam assembly 82 extending through the label applying assembly 26 and engageable with the baseplate 80. A recess 84 is defined in a mounting side 86 of the baseplate 80, the recess 84 extending along a length of the baseplate 80. The baseplate 80 may define a widened portion 88 of the recess 84 positioned towards an end of the baseplate 80 oriented away from the label applying zone 18. A through opening 90 is defined through the baseplate 80. The through opening 90 may be defined to be elongate having a T-shape with one part of the T defined lengthwise relative to the baseplate 80 and aligned with the recess 84 and the other part of the T defined to be aligned with the widened portion 88 of the recess 84. The baseplate 80 may define a plurality of bores 92 therethrough to receive one or more fasteners (not shown) for attachment of the baseplate 80 to the labeling apparatus 10. In some embodiments, the baseplate 80 may have a raised portion 94 (shown in FIG. 5) extending along the length of the baseplate 80 for engagement with one or more guides 96 positioned on a mounting side 98 of the label applying assembly 26. The guides 96 may define a channel/recess into which the raised portion 94 may engage.

Referring back to FIGS. 2-5, the cam assembly 82 includes a cam member 100 (cam), a shaft 102 having one end engaged with the cam 100, and a handle 104 coupled to an end of the shaft 102 opposite the cam 100. The cam 100 can be a plate having a thickness generally similar to a depth of the recess 84 in the mounting side 86 of the baseplate 80 and a shape having a width that is smaller than a width of a narrow portion 106 of the recess 84 and larger than a width of the through opening 90 so that the cam 100 fits into the recess 84 and is slideably engageable with the baseplate 80 without passing through the through opening 90. In one embodiment, the width of the cam 100 may be slightly smaller than the width of the narrow portion 106 of the recess 84. The cam 100 may have a bore 108 therein that may be threaded for engagement with the shaft 102. The shaft 102 extends through the label applying assembly 26, extends through the through opening 90 in the baseplate 80, and engages with the cam 100, which is positioned within the recess 84 on the mounting side 86 of the baseplate 80. The handle 104 is coupled to the end of the shaft 102 opposite the cam 100 and has a shoulder 109 that engages with the label applying assembly 26. In one embodiment, the shoulder 109 may be incorporated into the shaft 102 rather than the handle 104. The shoulder 109 provides a counter force against the label applying assembly 26 during tightening of engagement of the shaft 102 with the cam 100. The handle 104 may be used to rotate the shaft 102, causing the shaft 102 to tighten or loosen its engagement with the cam 100, which is held in place by the portions of the baseplate 80 defining the recess 84.

Moving the handle 104 to a lock position tightens the engagement of the shaft 102 with the cam 100, which forces the cam 100 against the mounting side 86 of the baseplate 80, thereby fixing a position of the label applying assembly 26 relative to the labeling apparatus 10. Moving the handle 104 to a release position loosens the engagement of the shaft 102 with the cam 100, which relaxes the force of the cam 100 against the mounting side 86 of the baseplate 80, thereby allowing the cam 100 to slide lengthwise along the recess 84 for changing the position of the label applying assembly 26. As the cam 100 slides along the recess 84, the shaft 102 travels along the lengthwise portion of the T-shape of the through opening 90. When the cam 100 reaches the widened portion 88 of the recess 84, the shaft 102 may reach the "T" in the through opening 90, at which point, the label applying assembly 26 may be moved laterally away from or closer to the labeling apparatus 10 as desired for accessing the printer components. The handle 104 may be used to further loosen the engagement of the shaft 102 with the cam 100 until the shaft 102 disengages from the cam 100, thereby facilitating removal of the entire label applying assembly 26 from the labeling apparatus 10. By disengaging the cam 100, the label applying assembly 26 may be exchanged with a different label applying assembly (not shown) configured for an alternative label campaign. Use of the modular format for the label applying assembly 26 enables different modules to be swapped in and out of the labeling apparatus 10 according to the particular label being applied, where different modules are sized according to match the length of the label being applied so that labels reach a nip zone just as they are released from the label stock, as will be described in more detail below.

Figure 6:
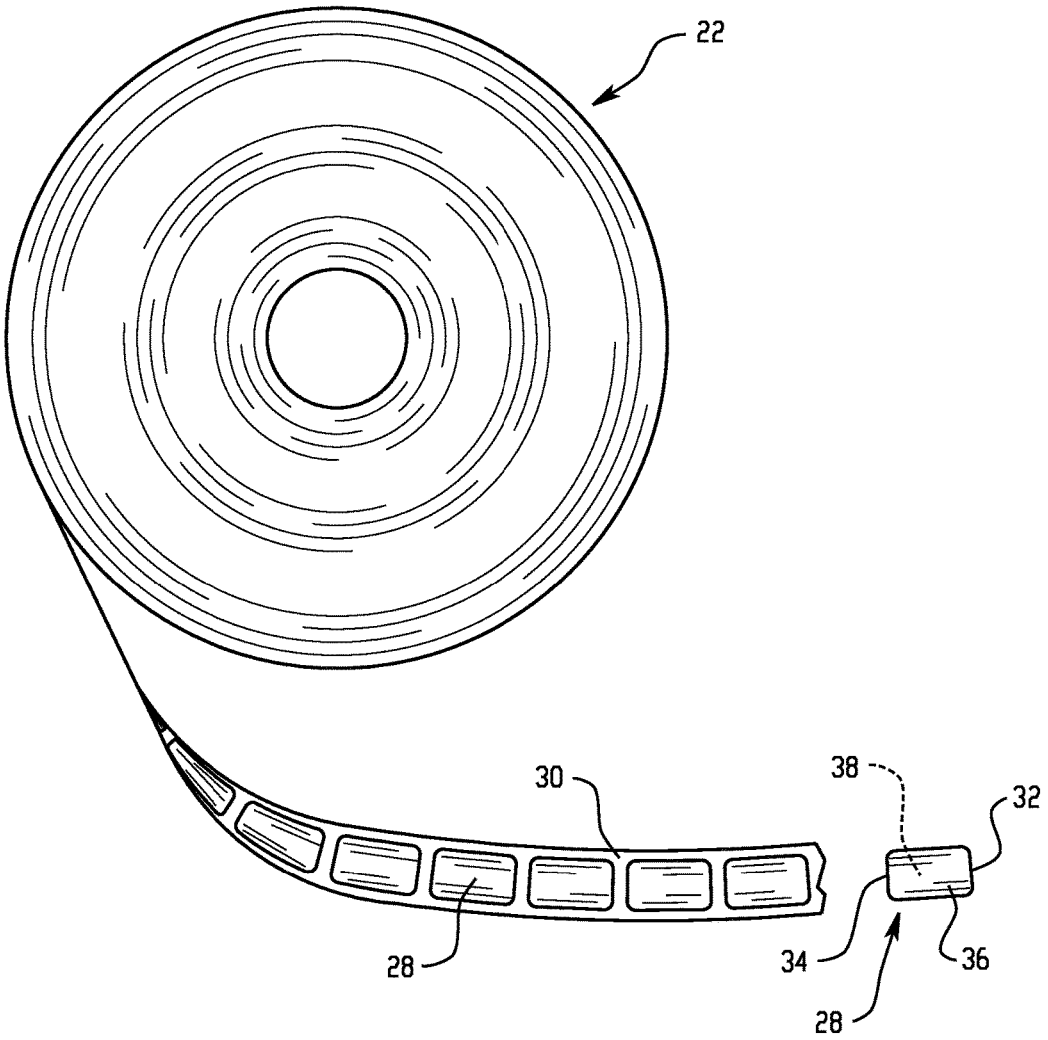
FIG. 6 is a side view of a typical roll of label stock.
Figure 7:
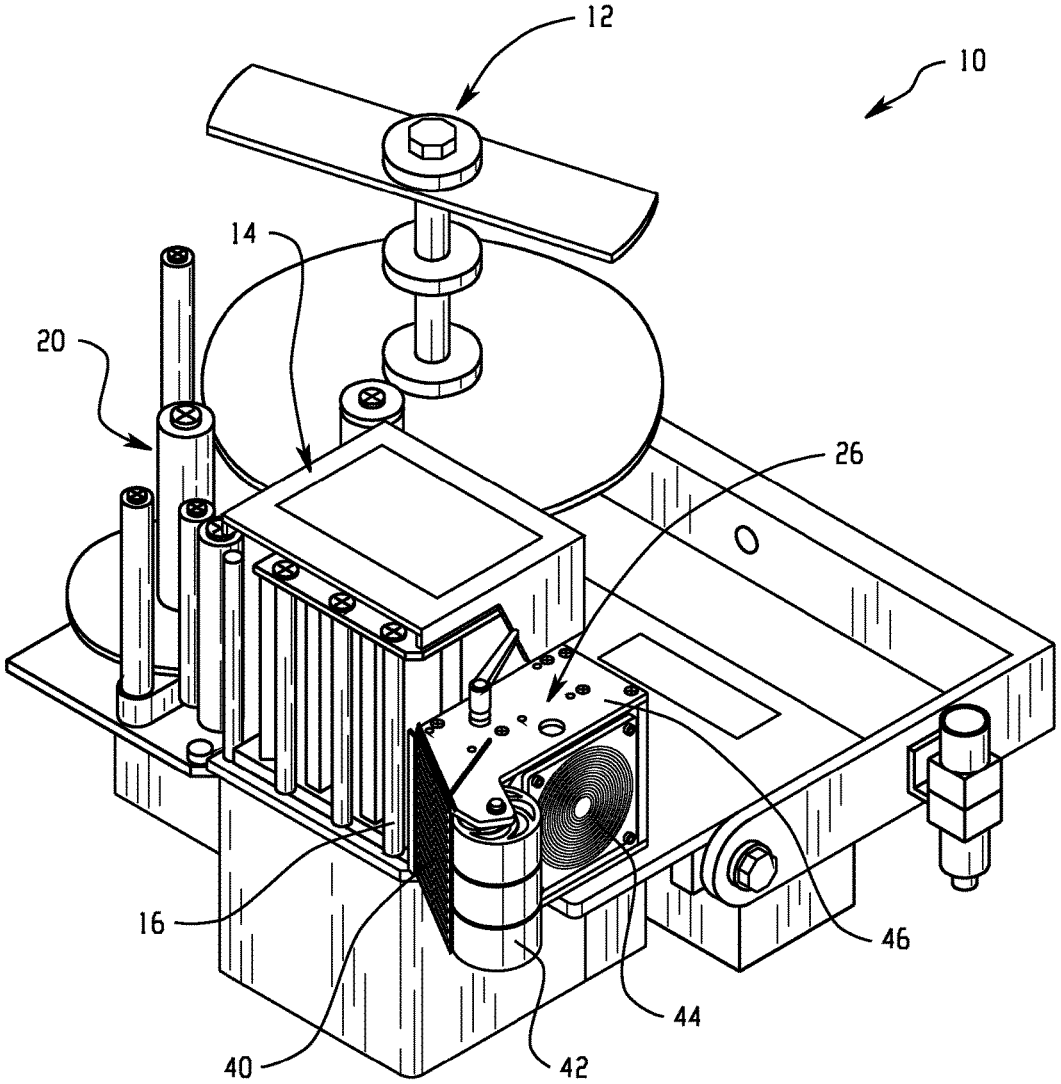
FIG. 7 is a bottom perspective view of the labeling apparatus.

FIG. 6 depicts an example of a roll of label stock 22 that may be applied to moving items using the label applying apparatus 10. The label stock 22 includes labels 28 removably/releaseably coupled to a backing 30 (also referred to as liner or label stock backing) that facilitates conveyance of the labels 28 through the labeling apparatus 10. Each label 28 has a leading edge 32, which is the first edge of the label 28 to travel along the label stock path 24, and a trailing edge 34, which is the last edge of the label 28 to travel along the label stock path 24. The labels 28 may generally be pressure sensitive adhesive labels having an adhesive label side 36, for engagement of the label 28 with the moving item intended to be labeled, and a non-adhesive label side 38. The non-adhesive label side 38 may be a printable substrate, a non-printable substrate, or a pre-printed surface. In other embodiments, the label stock 22 used may be liner-less label stock, in which case the label release mechanism 16 may operate to separate each label from the trailing length of label stock 22.

Figure 8:
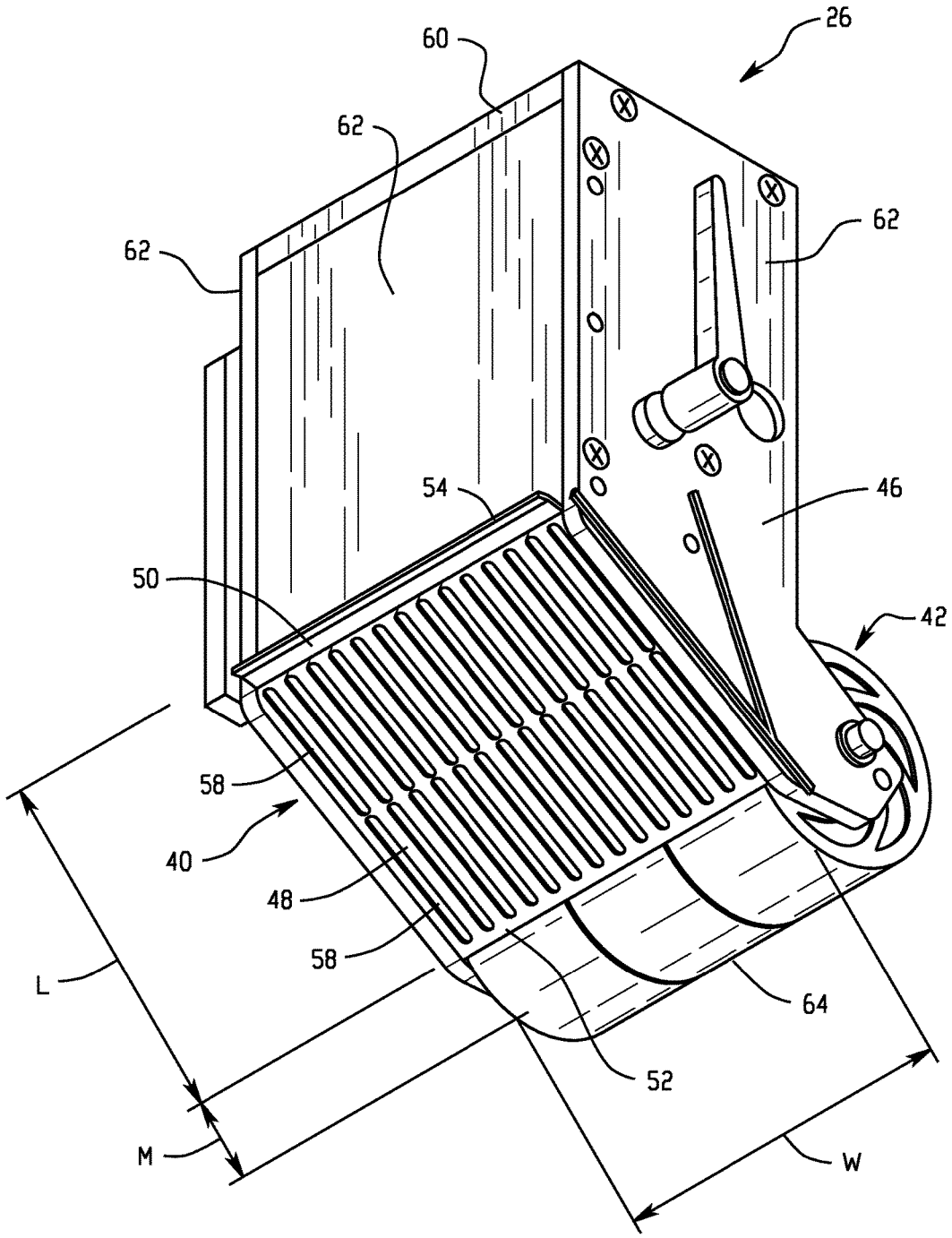
FIG. 8 is a bottom perspective view of a label applying assembly of the labeling apparatus of FIG. 7.

Referring now to FIGS. 7-11, the label applying assembly 26, which may also be referred to herein as a label merge module in the alternative, includes a plate 40, a roller 42, a fan 44, and a plenum 46 (internal of the assembly housing). The plate 40 has a support surface 48 positioned to receive a label 28 that has been released from the backing 30, an upstream end 50 positioned proximate to the label release mechanism 16, and a downstream end 52 positioned proximate to the roller 42. In some embodiments, the upstream end 50 of the plate 40 may have a lip portion 54 that extends towards the label release mechanism 16 to direct labels 28 being released towards the support surface 48 of the plate 40. Where the lip 54 is slightly offset from and partially overlaps with the label stock path 24 at the point of label release, the lip 54 helps to prevent the labels 28 from following an improper path upon release. The plate 28 also has a rear surface 56 facing away from the support surface 48 and the label 28 supported thereon. The plate 40 has one or more openings 58 to enable a negative pressure effect to occur at the support surface 48. The openings 58 can have any convenient shape, which can include, but is not limited to, circular, slotted, elliptical, square, rectangular, other shape, or combinations thereof. As shown in FIG. 8, the plate 40 can have a plurality of openings 58 arranged as two rows of evenly spaced slots. In other embodiments, the shape and orientation of the openings 58 in the plate 40 may vary. The primary portion of the plate 40 defining the support surface 48 may typically be planar as shown, but other variations are possible including plate configurations that result in some curvature in the support surface 48 and/or one or more angle changes in the support surface 48. The plate 40 may have any convenient thickness ranging from a thin plate to a thick plate that resembles more of a block.

Figure 9:
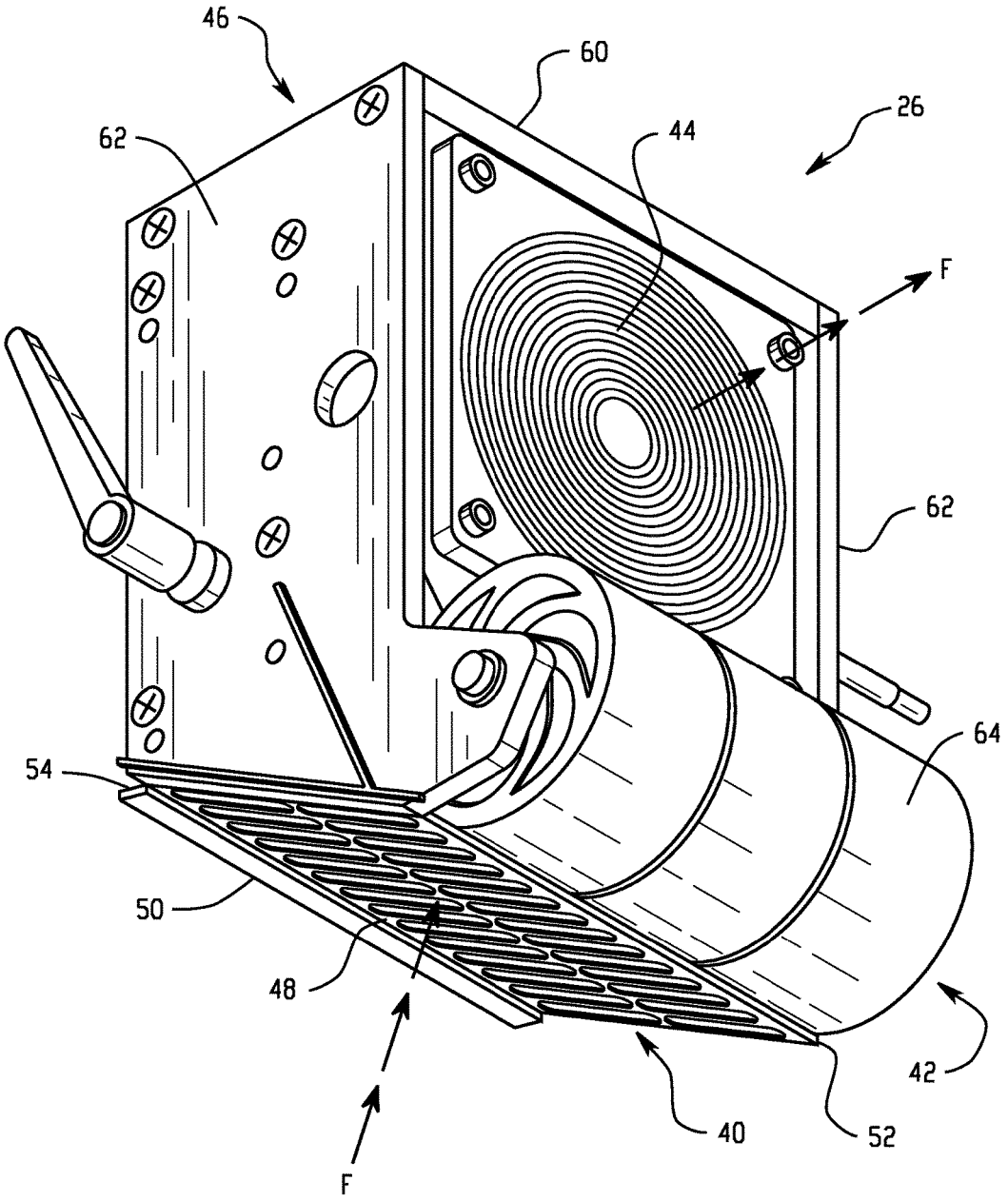
FIG. 9 is a side perspective view of the label applying assembly of FIG. 8.

As shown in FIG. 9, the fan 44 is positioned to draw an air flow F through the openings 58 in the plate 40, which air flow passes through the plenum 46 and is then exhausted from another side of the assembly. By drawing the air flow F through the openings 58 in the plate 40, the fan 44 creates a negative pressure effect at the support surface 48 of the plate 40. The fan 44 can be any convenient type or size of commercially available fan. The plenum 46 is defined by the rear surface 56 of the plate 40, an end wall 60 opposite the plate 40, and a plurality of side walls 62 extending from the plate 40 to the end wall 60. It is recognized that the fan 44 may be positioned in any one of the plurality of side walls 62 or in the end wall 60. The plenum 46 may be sealed to prevent air leakage, but embodiments having some air leakage may also be implemented.

Although the use of a fan is described above, alternative means for creating a negative pressure effect at the support surface 48 of the plate 40 may be used, which may include any means of creating a negative pressure known in the art. Such means for creating a negative pressure effect at the support surface 48 may include a Venturi apparatus, a vacuum pump, or other device capable of creating a negative pressure effect at the support surface 48 by drawing air through the openings 58 in the plate 40.

Figure 10:
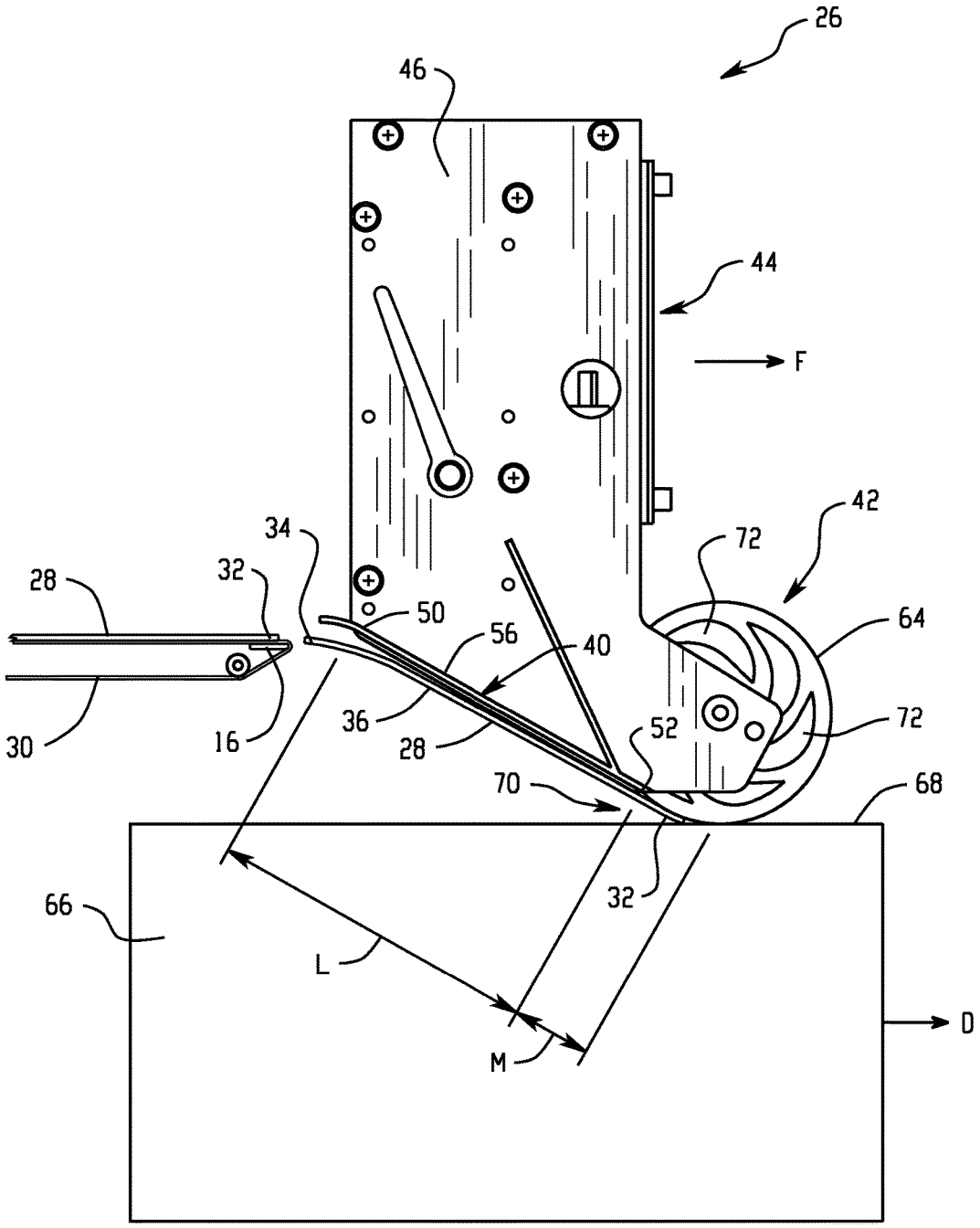
FIG. 10 is a front elevation view of the label applying assembly of FIG. 8.

Still referring to FIGS. 8-11, the roller 42 is positioned proximate to the downstream end 52 of the plate 40. The roller 42 is free-spinning and has an outer surface portion 64 that, as shown in FIG. 10, also is or can be positioned proximate to a moving item 66 to be labeled such that the outer surface portion 64 is in contact with an application surface 68 of the moving item 66 (also referred to herein as a moving item application surface). Contact between the outer surface portion 64 of the roller 42 and the application surface 68 of the moving item 66 creates a nip zone 70 where the outer surface portion 64 contacts the application surface 68. The nip zone 70 receives the leading edge 32 of a label 28 that has been released from the label stock backing 30 and pulls the label 28 forward into contact with the application surface 68 of the moving item 66. Because the roller 42 is free-spinning, contact between the outer surface portion 64 of the roller 42 and the application surface 68 of the moving item 66 causes a speed of the label 28 to be matched to a speed of the application surface 68 of the moving item 66 when the label 28 enters the nip zone 70. The free-spinning roller 42 matches the speed of the label 28 to the speed of the application surface 68 without having to synchronize the speed of the label 28 (or the speed of label printer in embodiments using a label printer) with the speed of the moving item 66 using electric motors, timers, controllers and other electronic equipment.

The outer surface portion 64 of the roller 42 may be compliant such that it conforms to irregular surfaces and/or varying distances. The outer surface portion 64 of the roller 42 may also be resilient so that the outer surface portion 64 durably and consistently re-conforms to an original shape in response to any deformation. The compliant and resilient properties of the outer surface portion 64 of the roller 42 allows the passing application surface 68 of the moving item 66 to partially displace the outer surface portion 64 of the roller 42, which re-conforms after the application surface 68 has passed. A roller 42 having an outer surface portion 64 that is compliant and/or resilient may also be referred to herein in the alternative as a compliant roller without implying a lack of resilience. The outer surface portion 64 of the roller 42 may also be non-stick so that adhesive and/or label faults do not accumulate on the outer surface portion 64 of the roller 42 to impede performance. The outer surface portion 64 of the roller 42 may be made from a resilient material, such as plastic, rubber, silicone rubber, or foam, for example. One or more surface treatments may be applied to the outer surface portion 64 to provide non-stick properties to the roller 42. In one embodiment, the outer surface portion 64 of the roller 42 may be a highly resilient, non-stick silicone rubber. In some embodiments, the roller 42 may have hollow windows 72 extending lengthwise through the roller 42, the windows 72 enabling the outer surface portion 64 to deform towards a central axis of the roller 42 to provide resilience. In operation, the application surface 68 of the moving item 66 partially displaces the outer surface portion 64 of the roller 42, which may deform. Because of the resilient nature of the roller 42, the outer surface portion 64 of the roller 42 seeks to maintain its original shape and exerts a force back against the application surface 68 of the moving item 66. When a label 28 moves through the nip zone 70, this force acts on the label 28, pressing the adhesive label side 36 against the application surface 68 to adhere the label 28 to the moving item 66.

Also due to the resilience of the roller 42, a degree of displacement/deformation of the outer surface portion 64 of the roller 42 constantly changes in response to changes in a contour of the application surface 68 of the moving item 66. This dynamic nature of the outer surface portion 64 of the roller 42 enables the roller 42 to maintain contact with the application surface 68 of the moving item 66 despite one or more contour irregularities 74 (shown in FIG. 12) in the application surface 68 and allows smooth application of the label 28 to the application surface 68.

Figure 11:
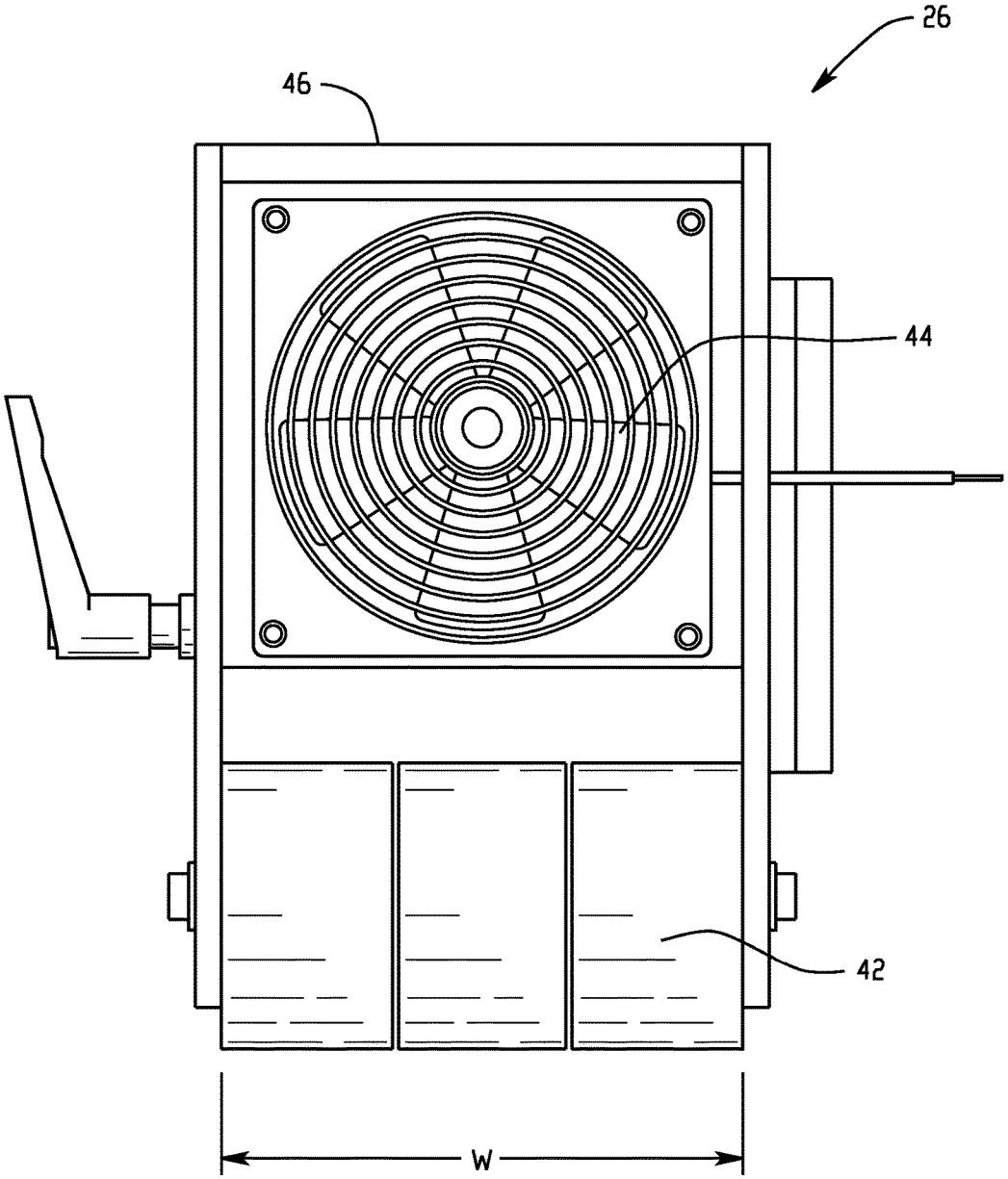
FIG. 11 is a side elevation view of the label applying assembly of FIG. 8.

Referring now to FIGS. 10-11, the plate 40 is positioned to extend from the release mechanism 16 to the roller 42. As indicated in FIG. 8, the plate 40 has a width W in a direction generally parallel to a rotational axis of the roller 42, and the width W may be selected to adequately support a lateral dimension of the label 28 (lateral referring to a cross-machine direction). As indicated in FIGS. 8 and 10, the plate 40 has a length L in a direction generally perpendicular to the rotational axis of the roller 42. A distance M is defined as the distance extending from the downstream end 52 of the plate 40 to the nip zone 70 and may depend, in some embodiments, on a size of the roller 42. Referring back to FIG. 10, the length L of the plate 40 may be selected so that the leading edge 32 of the label 28 reaches the nip zone 70 just as the trailing edge 34 of the label 28 is fully released from the label stock backing 30, in which case the total length L+M, is slightly larger than the label length. In some embodiments, the length L may also be selected so that the leading edge 32 of the label 28 reaches the nip zone 70 before the label 28 loses momentum moving across the support surface 48 of the plate 40.

Figure 12:
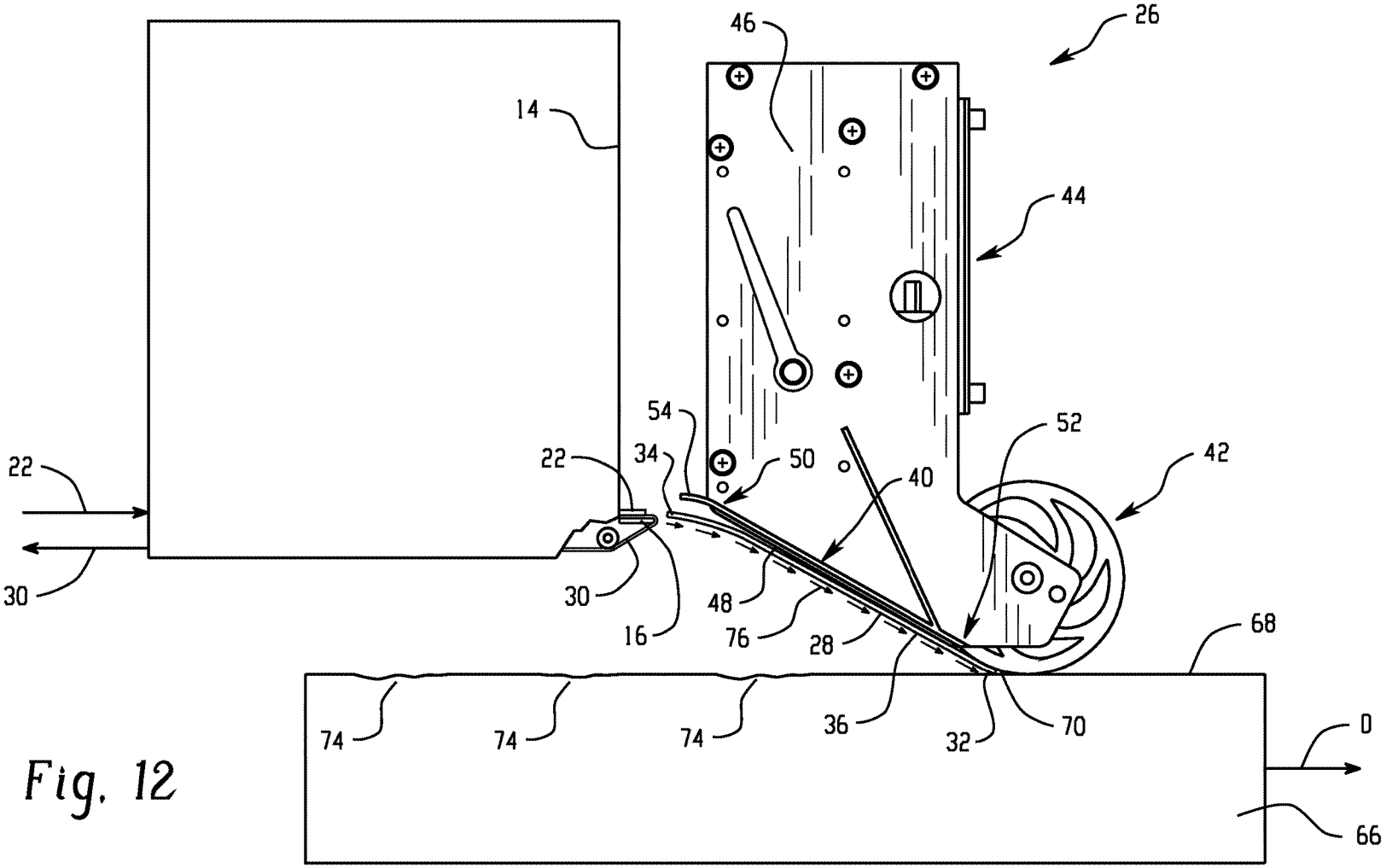
FIG. 12 is a partial front elevation view of another embodiment of a labeling apparatus illustrating operation of the label applying assembly.

Referring now to FIG. 12, operation of the label applying apparatus 10 will be described. Label stock 22 is fed by the label drive mechanism (not shown) from the label stock supply reel (not shown) to the label printer 14. In some embodiments, the label stock 22 may include pre-printed labels 28 and may not require the use of a label printer 14, in which case the label stock 22 may feed directly to the release mechanism 16. The label stock 22 then passes over a release mechanism 16, which releases the label 28 from the label stock backing 30. The label release mechanism 16 may include, but is not limited to, a release bar, release roller, release plate, peel bar, peel edge, or other release mechanism. In FIG. 12 the label stock 22 passes tightly over the release mechanism 16, and the tight travel path of the label stock 22 around the release mechanism 16 causes the leading edge 32 of the label 28 to separate from the label stock backing 30. The leading edge 32 of the label 28 continues to travel towards the plate 40 as the label 28 continues to release from the label stock backing 30. The adhesive label side 36 of the label 28 faces generally away from the support surface 48 of the plate 40.

The fan 44 creates an air flow through the openings 58 in the plate 40, and the air flow in turn creates a negative pressure effect (partial vacuum effect) along the support surface 48 of the plate 40. As shown in FIG. 12, a label release path 76 (label guide path) is defined to extend from the release mechanism 16, to the upstream end 50 of the plate 40, across the plate 40 from the upstream end 50 to the downstream end 52, and into the nip zone 70 created between the roller 40 and the application surface 68 of the moving item 66. The leading edge 32 of the label 28 follows the label release path 76 to contact the support surface 48 of the plate 40. The negative pressure effect at the support surface 48 maintains the label 28 in contact with the support surface 48 and keeps the label 28 straight as the label 28 moves along the label release path 76. As the leading edge 32 of the label 28 moves along the label release path 76, the label 28 continues to release from the label stock backing 30. At the end of the label release path 76, the leading edge 32 reaches the roller 40 and the nip zone 70 just as the trailing edge 34 of the label 28 releases from the stock label backing 30.

The outer surface portion 64 of the roller 42 contacts the application surface 68 of the moving item 66, moving in direction D, such that the application surface 68 partially displaces the outer surface portion 64 of the roller 42. As the leading edge 32 of the label 28 enters the nip zone 70, the roller 42 pulls the leading edge 32 of the label 28 into contact with the application surface 68 of the moving item 66. Because the roller 42 is free-spinning, the roller 42 rotates to match a speed of the application surface 68 of the moving item 66. The roller 42, therefore, accelerates or decelerates the label 28 such that a speed of the label 28 generally matches the speed of the application surface 68 of the moving item 66, which enables smooth application of the label 28 to the moving item 66. As the label 28 passes through the nip zone 70, the adhesive label side 36 of the label 28 is placed in contact with the application surface 68 of the moving item 66. As previously described, the partial displacement of the outer surface portion 64 of the roller 42 exerts a force against the label 28, pressing the adhesive label side 36 against the application surface 68, thereby adhering the label 28 to the application surface 68 of the moving item 66. The label 28 continues to move through the nip zone 70 until the trailing edge 34 is adhered to the application surface 68 of the moving item 66 and the moving item 66 moves past the label applying apparatus 10 in direction D.

Figure 13:
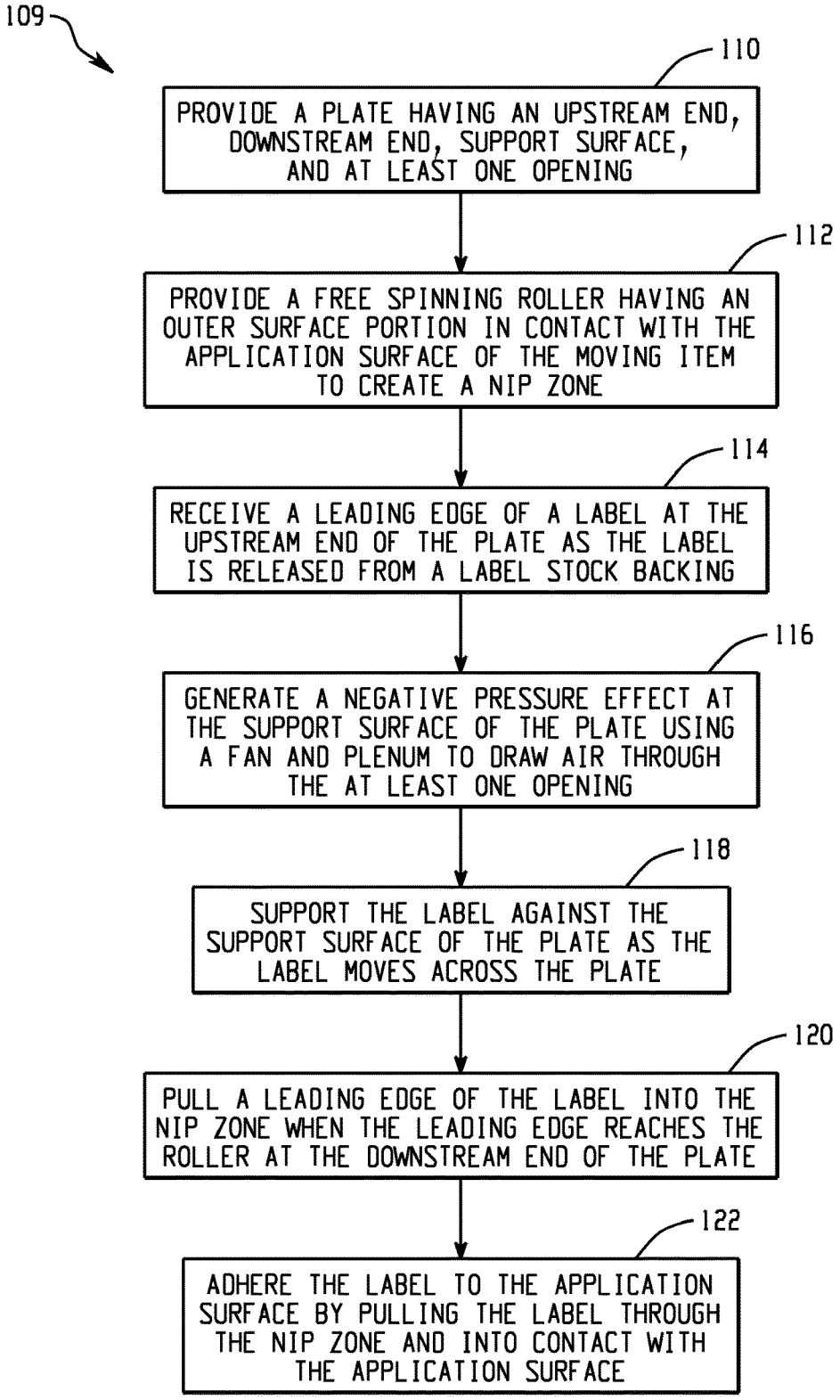
FIG. 13 is a flow chart of an embodiment of a method for applying a label to a moving item using the labeling apparatus.

Referring now to FIG. 13, a method for applying a label to a moving item 109 is described. The method for applying a label to a moving item 109 includes utilizing a label support surface 110 having an upstream end, a downstream end, and at least one opening and utilizing a free-spinning roller 112 having an outer surface portion. The roller is proximate to the downstream end of the label support surface and positioned to have the outer surface portion in contact with an application surface of the moving item to be labeled to create a nip zone therewith. Method 109 further includes the following: receiving a leading edge of a label 114 at the upstream end of the label support surface as the label is released from a label stock supply; generating a negative pressure effect 116 at the label support surface to draw an air flow through the openings in the label support surface; supporting the label 118 as it moves across the label support surface, the support provided by the negative pressure effect at the label support surface that holds the label against the support surface as the label moves into the nip zone; and adhering the label to the application surface of the moving item by moving the label through the nip zone as the rotating roller presses an adhesive side of the label against the application surface.

In some embodiments, the method of applying a label to a moving item 109 further includes matching a speed of the label with a speed of the application surface of the moving item. In this speed matching step, the roller accelerates or decelerates the label as it moves into the nip zone to match the speed of the label with the sped of the application surface. In some embodiments, the method of apply a label to a moving item 109 includes the step of compensating for one or more contour irregularities in the application surface of the moving item. In this additional step, the roller is a compliant roller having an outer surface portion that is resilient, and the outer surface portion is partially displaced through contact with the application surface of the moving item. The degree of partial displacement of the outer surface portion of the roller changes in response to the one or more contour irregularities in the application surface.

The labeling apparatus of the present application may reduce the complexity of labeling operations in terms of operation and/or adjustment by reducing the number of pieces and moving parts. Embodiments of the disclosed labeling apparatus may reduce the reliance of labeling operations on plant air, which may reduce energy costs of the labeling operation. Some embodiments of the labeling apparatus may enable the speed of the label to be matched to the speed of the moving item, thus allowing the print speed to vary from the conveying speed and eliminating use of complex controls to synchronize the label speed to the conveyance speed. Embodiments of the labeling apparatus may also enable the labeling system to compensate for contour irregularities of the moving item and apply the labels smoothly regardless of the condition of the moving item, which may improve the reliability of the labeling operation.

The foregoing is provided for purposes of illustrating, explaining, and describing embodiments of labeling apparatus. Modifications and adaptations to these embodiments will be apparent to those skilled in the art and may be made without departing from the scope or spirit of this application.

What is claimed is:

1. A label applying apparatus, comprising:

a conveyance path along which a moving item is being conveyed;

a label release mechanism for releasing a label from a label stock backing along a release path;

a plate having a support surface with at least one opening through the plate, the support surface having an upstream end and a downstream end, the upstream end positioned to receive the label exiting the release mechanism along the release path, wherein the upstream end of the support surface is spaced further from the conveyance path than the downstream end of the support surface and the support surface forms part of the release path;

a fan positioned to create a negative pressure effect at the at least one opening in the support surface of the plate for holding the label against the support surface as the label travels along the support surface toward the conveyance path; and a free-spinning roller positioned at the downstream end of the support surface, the free-spinning roller having an outer surface portion adjacent to and aligned with the support surface to form an end part of the release path for receiving a leading edge of the label from the support surface before application of the label to the moving item, wherein the outer surface portion of the roller includes a nip zone positioned for contacting an application surface of the moving item to apply the label to the moving item as the label continues to move from the support surface onto the outer surface portion of the roller.

2. The label applying apparatus of claim 1, wherein the label release mechanism releases the label with a non-adhesive label side facing the support surface and an adhesive label side facing away from the support surface.

3. The label applying apparatus of claim 1, wherein the roller is a compliant roller and the outer surface portion is resilient.

4. The label applying apparatus of claim 3, wherein the application surface contacts and displaces the outer surface portion of the compliant roller in the nip zone.

5. The label applying apparatus of claim 1, wherein contact between the outer surface portion of the roller and the application surface causes a speed of the label to be matched to a speed of the application surface during application of the label.

6. The label applying apparatus of claim 1, wherein the fan is positioned to create a flow of air through the at least one opening in the plate, from the support surface to a rear surface, thereby creating the negative pressure effect along the support surface of the plate.

7. The label applying apparatus of claim 6, further comprising a plenum extending from a rear surface of the plate.

8. The label applying apparatus of claim 7, wherein the fan is positioned in the plenum.

9. The label applying apparatus of claim 1, wherein the plate is dimensioned so that the leading edge of the label reaches the nip zone just after a trailing edge of the label fully releases from the label stock backing at the label release mechanism.

10. The label applying apparatus of claim 1, wherein the plate is dimensioned so that the leading edge of the label reaches the nip zone before a forward momentum of the label along the support surface ceases.

11. The label applying apparatus of claim 1, further comprising:

a label printer located along a label stock path upstream of the label release mechanism; and a label stock drive arrangement for moving label stock along the label stock path past the printer and about the label release mechanism, wherein a linear speed of the label stock drive arrangement does not match a linear speed of the moving item.

12. A label merge module comprising:

a housing with an internal plenum, the housing including a plurality of walls;

a label support surface on the housing and having an upstream end and a downstream end and at least one opening therethrough, the at least one opening located between the upstream end and the downstream end and the at least one opening leading to the plenum:

a means for creating a negative pressure effect between the plenum and the at least one opening in the label support surface for holding labels against the label support surface as the labels travel along the label support surface from the upstream end to the downstream end; and a free-spinning roller mounted on the housing and positioned at the downstream end of the label support surface, the roller including an outer surface positioned adjacent to and aligned with the downstream end of the support surface for receiving labels from the label support surface to apply the labels to moving items;

wherein the housing, the label support surface, the means for creating a negative pressure effect and the roller form an integrated assembly.

13. The label merge module of claim 12, wherein the means for creating the negative pressure effect is a fan positioned to draw air through the at least one opening of the support surface.

14. The label merge module of claim 13, wherein the fan is positioned to draw air through the plenum.

15. The label merge module of claim 12, further comprising a mounting channel formed on a mounting side of the housing.

16. A label merge module comprising:

a label support surface with an upstream end and a downstream end and at least one opening therethrough, the at least one opening located between the upstream end and the downstream end:

a means for creating a negative pressure effect at the at least one opening in the label support surface for holding labels against the label support surface as the labels travel along the label support surface from the upstream end to the downstream end; and a free-spinning roller positioned at the downstream end of the label support surface for receiving labels from the label support surface to apply the labels to moving items;

a service feature moveably engaging the label merge module with a labeling apparatus, wherein the service feature comprises:

a baseplate fastened to the labeling apparatus, the baseplate defining a recess and a through opening;

a cam assembly having a cam slideably engageable with the recess of the baseplate and a shaft engageable with the cam and extending through the through opening of the baseplate to engage with the label merge module; and wherein tightening engagement of the shaft with the cam engages the cam with the baseplate to define a position of the label merge module relative to the labeling apparatus, and wherein loosening engagement of the shaft with the cam allows the cam to slide along the recess defined by the baseplate to change the position of the label merge module relative to the labeling apparatus.

17. A label applying apparatus comprising:

a conveyance path along which a moving item is being conveyed;

a label stock traveling along a label stock path that includes an associated label release mechanism that releases a label from the label stock and to a label guide path that runs toward the conveyance path;

a support surface defining part of the label guide path;

a roller defining an end of the label guide path and positioned to be in contact with an application surface of the moving item conveyed along the conveyance path to create a nip between the roller and the application surface, wherein the roller is free-spinning;

wherein the support surface is positioned to receive the label as it releases from the label stock and to support the label until it reaches the roller; and wherein an outer surface of the roller is positioned adjacent to and aligned with a downstream end of the support surface;

wherein a distance from the label release mechanism to the nip is slightly larger than a length of the label so that a leading edge of the label reaches the nip just after a trailing edge of the label fully releases from the label stock.

18. The label merge module of claim 17, further comprising at least one opening in the support surface and a fan positioned to create a negative pressure effect at the at least one opening in the support surface.

19. The label merge module of claim 15 further comprising a cam member located in the mounting channel, a handle located on a side of the housing opposite the mounting side, and a shaft connecting the handle to the cam member.

* * * * *